US005653002A

United States Patent [19]

Ishihara et al.

[11] Patent Number: 5,653,002

[45] Date of Patent: Aug. 5, 1997

[54] SLIDE FASTENER

[75] Inventors: Kiyomitsu Ishihara; Yoshiharu Yamaguchi; Osamu Maeda; Takeshi Inaba; Toyosaku Ogura, all of Toyama-ken, Japan

[73] Assignee: YKK Corporation, Tokyo, Japan

[21] Appl. No.: 633,182

[22] Filed: Apr. 18, 1996

Related U.S. Application Data

[63] Continuation of Ser. No. 493,531, Jun. 22, 1995, abandoned.

[30] Foreign Application Priority Data

Jun. 27, 1994 [JP] Japan ..... 6-144960

[51] Int. Cl.[6] ..... A44B 19/00

[52] U.S. Cl. ..... 24/390; 24/433

[58] Field of Search ..... 24/390, 399, 387, 24/403, 433

[56] References Cited

U.S. PATENT DOCUMENTS

| | | | |
|---|---|---|---|
| 2,688,784 | 9/1954 | Fenton . | |
| 2,792,610 | 5/1957 | Erdmann | 24/390 |
| 2,867,878 | 1/1959 | Sundback | 24/390 |
| 3,287,779 | 11/1966 | Sinderman | 24/390 |
| 3,605,208 | 9/1971 | Carlile | 24/390 |
| 3,831,227 | 8/1974 | Beitter . | |
| 4,187,791 | 2/1980 | Moertel . | |
| 5,400,482 | 3/1995 | Oda . | |
| 5,443,535 | 8/1995 | Oda . | |

FOREIGN PATENT DOCUMENTS

| | | | |
|---|---|---|---|
| 0 092 789 | 11/1983 | European Pat. Off. . | |
| 0 141 379 | 5/1985 | European Pat. Off. . | |
| 0 576 986 | 1/1994 | European Pat. Off. . | |
| 2 240 704 | 3/1975 | France . | |
| 29 37 563 | 4/1981 | Germany . | |
| 626241 | 11/1981 | Switzerland . | |
| 510611 | 8/1939 | United Kingdom . | |
| 2125885 | 3/1984 | United Kingdom | 24/390 |
| 2 166 488 | 5/1986 | United Kingdom . | |

*Primary Examiner*—Victor N. Sakran

*Attorney, Agent, or Firm*—Hill, Steadman & Simpson

[57] ABSTRACT

A slide fastener having a split arrester for preventing a pair of interengaged fastener stringers S from accidental splitting when a slider is removed. The split arrester comprises interlocking male and female members mounted on a pair of fastener stringers contiguously to the respective terminal portions of opposed coupling element rows and substantially equal in thickness and width of the coupling elements E. The male member has a locking tongue portion projecting from an attachment base portion toward the female member and terminated in a protuberance. The female member has a locking hollow portion, for receiving the locking tongue portion and having a pair of resilient catch portions for gripping the neck of the protuberance from opposite sides in the direction of thickness of the fastener tape.

14 Claims, 8 Drawing Sheets

SLIDE FASTENER

This is a continuation of application Ser. No. 08/493,531, filed Jun. 22, 1995 now abandoned.

BACKGROUND OF THE INVENTION

1. Field of the Invention

This invention relates to a slide fastener suitable for use in attaching a cover sheet to a seat of a car, etc. and connecting a huge sheet with another, and more particularly to a slide fastener which can keep in a closed state after a slider is removed from a pair of coupling element rows, with the slide fastener closed, in attaching a cover sheet or joining sheets or the like.

2. Description of the Related Art

Conventionally, in slide fasteners to be used in attaching a seat cover and connecting artificial turfs, carpets, etc., sliders are left each on opposed coupling element rows after the individual slide fasteners are closed. Since the seams of the sheets bulge locally due to the sliders remaining, the resulting sheet would have an unsightly appearance, and particularly in the case of artificial turfs, carpets or the like, the individual slide fastener tends to split as the corresponding slider is broken when stamped, and otherwise the sliders might hurt an athlete's body when he or she falls on the turf. In order to avoid these inconveniences, for example, Japanese Patent Laid-Open Publication No. HEI 6-14806 discloses a concept of removing the slider from the fastener chain after the sheets are join by closing the slide fastener and attaching a top stop assembly to the opposed fastener tapes contiguously to top ends of the opposed coupling element rows to retain the coupled state of the coupling elements after the slider is removed.

In joining sheet-like articles, such as seat covers, artificial turfs and carpets, by closing the opposed fastener stringers sewn to connecting edges, since pulling forces perpendicular to the coupling element rows act on the fastener chain in opposite directions, the coupling element rows tend to split. Consequently, the fastener chain is extended in such a manner that the terminal portions of the coupling element rows project beyond the end of connecting edge of the sheet in an effort that the pulling forces do not act at the terminal portions of the coupling element rows. After the sheets are joined together, the projected part of the fastener chain is folded inwardly of the sheets so that the appearance of the sheets are not impaired and so that the closed fastener chain is prevented from being split.

In the slide fastener disclosed in Japanese Patent Laid-Open Publication No. HEI 6-14806, the attachment base portions of male and female members of the top stop assembly attached to the terminal portions of the coupling element rows extends beyond the end of the connecting edges of the sheets, or cutaways are formed in the fastener tapes about the top stop assembly, so that the male and female members of the top stop assembly are retained in an interlocked state in such a manner that the opposite pulling forces acting on the fastener stringers does not influence on the interlocking force of the top stop assembly members, thereby preventing the coupling element rows from splitting. As is apparent from the foregoing description, in this conventional type of slide fasteners, in order to prevent the coupling element rows from being split due to the opposite pulling forces acting on the fastener chain, the slide fastener is set longer than the length of the actual seem of the sheets so that the terminal portions of the coupling element rows extend beyond the end of the connecting edges of the sheets.

With this arrangement, partly because the cost of production is increased and partly because the end portion of the fastener chain projects from the end of the connecting edges of the sheets, it is necessary to fold the end portion of the fastener chain under the sheets.

Particularly in the slide fastener disclosed in Japanese Patent Laid-Open Publication No. HEI 6-14806, in order to prevent the coupling element rows from being split due to the opposite pulling forces acting on the fastener chain, it is necessary to cut the top-stop-attaching tape portions of the slide fastener in chevron so that the number of manufacturing steps is increased to lower the productivity.

Further, the uneven surface of ground in the case of turfs and carpets and the curved surfaces of a seat in the case of seat cover cause the fastener chain to bend to give thrusting forces on the coupling elements in the direction of thickness of the fastener tape so that the coupling element rows tend to split. The conventional top stop assembly members has however only inadequate interlocking force against the thrusting force acting on the coupling elements in the direction of thickness of the fastener tape.

SUMMARY OF THE INVENTION

It is therefore an object of this invention to provide a slide fastener having a split arrester for preventing a pair of interengaged coupling element rows from splitting after a slider is removed from the interengaged coupling element rows, which fastener includes male and female members of the split arrester which are mounted on the fastener tapes with adequate firmness against forces from various directions. And the terminal portion of the fastener chain does not have to project from the end of connecting edges of sheets to be joined, thereby improving the rate of production and the cost of production.

In order to accomplish the above object, this invention provides a slide fastener including a split arrester which comprises male and female members being mounted on inner edges of opposed fastener tapes of fastener stringers at positions contiguous to top ends of coupling element rows, being disposed in confronting relation with thickness and width substantially equal to those of coupling elements, and engaging with each other when a slider is removed from the stringers. The slide fastener is characterized in that the male member of the split arrester includes a locking tongue portion projecting from an attachment base portion toward the female member, and that the female member includes a locking hollow portion to receive the locking tongue portion and a catch portion to engage with the locking tongue portion in the locking hollow portion in a direction of thickness of the slide fastener.

Preferably, the female member has an escape through hole communicating with the locking hollow portion.

According to a first embodiment of the invention, the slide fastener is characterized in that the locking tongue portion has on its distal end a protuberance to define a neck, and the catch portion is in the form of a pair of resilient bars extending longitudinally of the fastener tape between front and rear inside wall surfaces of the locking hollow portion and being parallel spaced a predetermined distance from each other in the direction of thickness of the fastener tape for pinching the neck from opposite sides in the direction of thickness of the fastener tape.

Preferably, the locking tongue portion of the male member has a generally T-shape cross section and the protuberance bulges in the direction of thickness of the fastener tape. And the locking hollow portion of the female member has a generally C-shape cross section in which the locking tongue portion is received and held. As a modification of the first embodiment, non-resilient catch portions extending from upper and lower part of wall surfaces of the locking hollow portion in parallel for engaging the protuberance of the locking tongue portion in the direction of thickness of the fastener tape may be provided at an open end of the locking hollow portion, and the locking tongue portion is resiliently deformable through its entire length between the catch portions.

According to a second embodiment of the invention, the slide fastener is characterized in that the locking tongue portion has at its distal end a resilient hook-shape end extending in the direction of thickness the fastener tape, and that the catch portion projects in the locking hollow portion in the direction of thickness of the fastener tape for engaging the resilient hook-shape end.

Preferably, the locking tongue portion of the male member has an aperture to which the resilient hook-shape end faces as being folded. The resilient hook-shape end of the locking tongue portion may have a single-hook structure.

Alternatively, a pair of opposite resilient hook-shape ends are provided on the locking tongue portion and a pair of catch portions extend so as to engage with the resilient hook-shape ends in the direction of thickness of the fastener tape.

Preferably, the female member has an escape through hole communicating with the locking hollow portion in its wall at a position confronting the resilient hook-shape end.

As a modification of the second embodiment, there may be arranged a plurality of the resilient hook-shape end of the locking tongue portion longitudinally of the fastener tape, the resilient hook-shape ends projecting alternately upwardly and downwardly in a direction of thickness of the fastener tape. In that case, the locking hollow portion is a multiple-hollow structure composed of a plurality of hollow portions for receiving the resilient hook-shape ends individually, with a plurality of the catch portion extending in the respective locking hollow portions to engage the respective resilient hook-shape ends in the direction of thickness of the fastener tape.

According to a third embodiment of the invention, the split arrester comprises male and female members being mounted on inner edges of opposed fastener tapes of fastener stringers at positions contiguous to top ends of coupling element rows, being disposed in confronting relation with thickness and width substantially equal to those of coupling elements, and engaging with each other when a slider is removed from the stringers. The male member has a locking tongue portion which projects from an attachment base portion toward the female member, has a generally T-shape cross section and has on its distal end a protuberance bulging in opposite directions longitudinally of the fastener tape. The female member has a locking portion of a generally C-shape cross section in which the locking tongue portion is received and held at front and rear sides of a neck thereof, with first and second catch projections provided on opposed inside wall surfaces of the locking portion toward each other for engaging the protuberance of the locking tongue portion being provided at an open end of the locking portion. And at least one of the first and second catch projections is composed of a resilient material for pressing a front or rear side of the neck resiliently.

Preferably, the locking portion having the first or second catch projections which are made of material other than the resilient material, has a recess on an inside wall surface thereof for receiving the protuberance of the locking tongue portion.

Further preferably, the female member is made of synthetic resin material and the locking portion has a vertical through hole at a position toward the second catch projection so that the through-hole-side part of the locking portion is resiliently deformable entirely.

According to a fourth embodiment of the invention, the split arrester comprises male and female members being mounted on inner edges of opposed fastener tapes of fastener stringers at positions contiguous to top ends of coupling element rows, being disposed in confronting relation with thickness and width substantially equal to those of coupling elements, and engaging with each other when a slider is removed from the stringers. The male and female members includes a plurality of coupling elements mounted on longitudinal inner edges of the opposed fastener stringers in a staggered manner, legs of the coupling elements being connected by welding using a synthetic resin material.

Preferably, the coupling elements are coiled elements, and the synthetic resin material is in the form of a strip extending over a number of coupling elements.

In operation, after the slide fastener of this invention is attached to the sheets or the like, the slider is operated as usual to close the slide fastener and is then removed from the fastener chain. When the slider is removed from the fastener chain, the locking tongue portion of the male member automatically comes into interlocking engagement with the locking hollow portion and catch portion of the female member in the direction of thickness of the fastener tape. After removal of the slider, the interlocking engagement of the male and female members will not be released even if the lateral pulling forces act on the fastener tapes or even if thrusting forces act on the coupling element rows in the direction of thickness of the fastener tape. If the interlocking engagement of the locking tongue portion of the male member with the female member takes place at front and rear positions spaced apart longitudinally of the fastener tape, the resilient portion of the female member strongly acts on the locking tongue portion forwardly and rearwardly thereof. Particularly the resilient portion of the female member acts much more strongly when the forces acting on the locking tongue portion in the direction of release of the locking tongue portion, the locking tongue portion does not get released from the female member easily. Further, if the front and rear inside wall surfaces of the locking hollow portion of the female member have a pair of recesses in which the protuberances of the locking tongue portion are to be fitted, the resilient pressure acting on the front and rear side surfaces of the locking tongue portion serves to assist in preventing the locking tongue portion of the male member from being accidentally removed from the female member in the direction of thickness of the fastener tape even when the thrusting force acts in the direction of tape thickness.

Further, if the split arrester includes a number of coupling elements of each of the opposed fastener stringers and the leg portions of these coupling elements of each fastener stringer are welded together using a connecting strip of synthetic resin material, possible resilient deformation of the coupling elements welded by the connecting strips is suppressed and the interlocking strength of the coupling heads is improved greatly.

Thus if the slide fastener of this invention, in which the male and female members of the split arrester have an adequate degree of interlocking strength against the forces acting in the directions of thickness and width of the fastener tape, is sewn to the respective connecting edges of the sheets, the male and female members are free from accidental disengagement, thus eliminating the necessity that the terminal portion of the fastener chain extends beyond the end of sewn seam of the sheets as conventional.

DETAILED DESCRIPTION OF THE PREFERRED EMBODIMENTS

Figure 1:
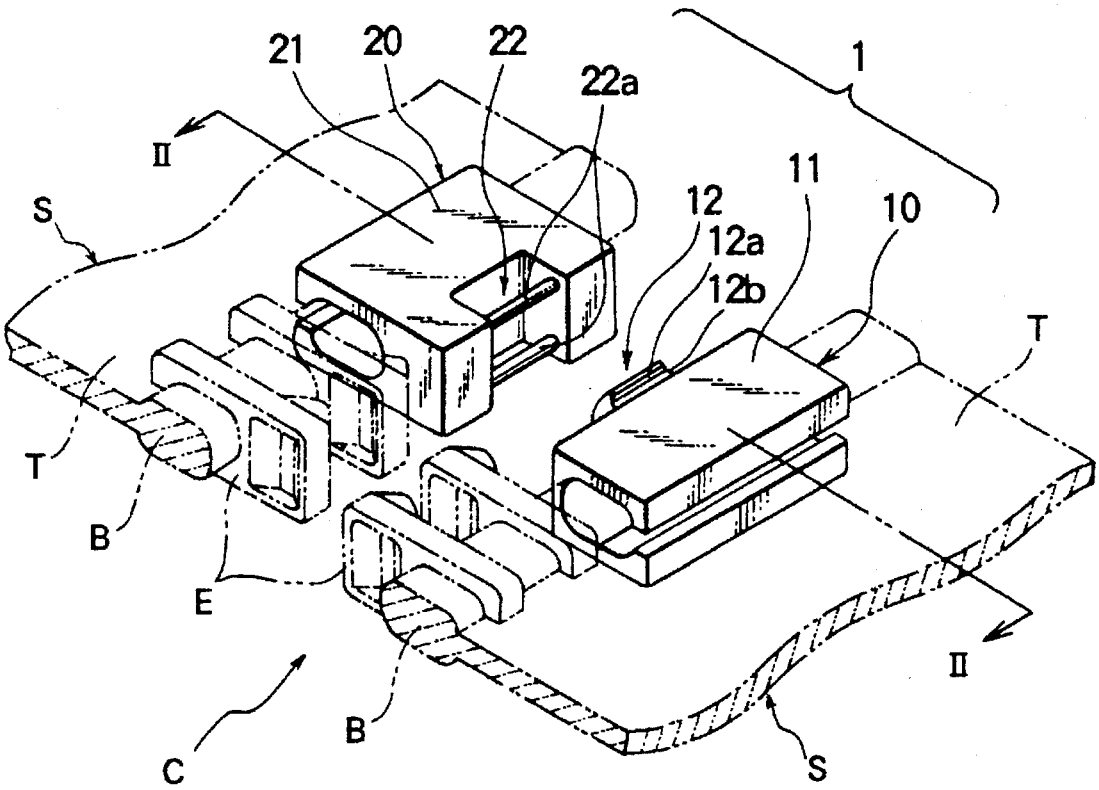
FIG. 1 is a fragmentary perspective view showing a split arrester of a slide fastener according to a first embodiment of this invention.
Figure 2:
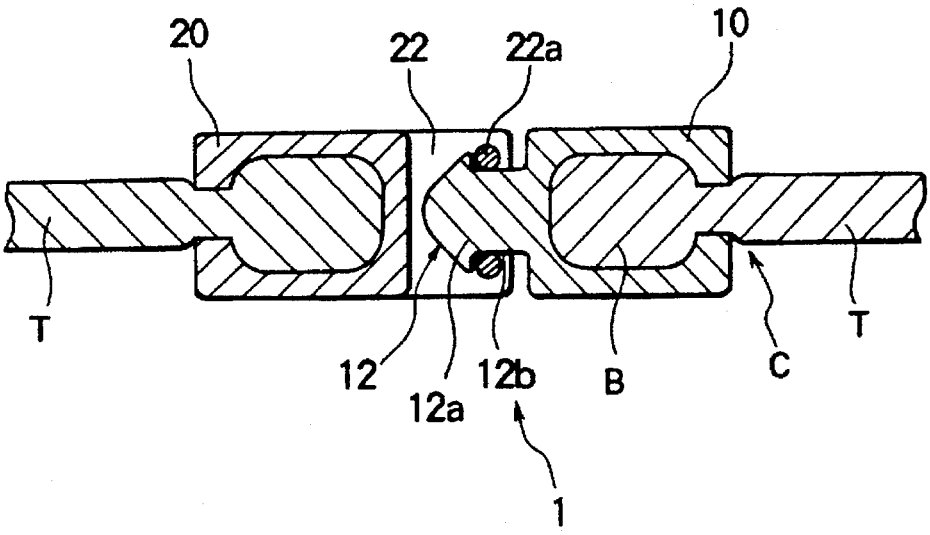
FIG. 2 cross-sectional view taken along line II—II of FIG. 1

Embodiments of this invention will now be described in detail. FIG. 1 shows a first typical embodiment of a split arrester 1 applied to a slide faster according to this invention. The split arrester 1 is composed of male and female members 10, 20 mounted on a pair of fastener stringers S at positions contiguous to the respective terminal portions of opposed coupling element rows. Each of the male and female members 10, 20 has an attachment base portion 11, 21 surrounding a core-thread attaching portion of each fastener stringer S and gripping the inner edge of the respective fastener tape in the direction of thickness of the fastener tape. The split arrester 1 is made of the same material, such as various kinds of metal or synthetic resin, as the coupling elements; when the male and female members 10, 20 are interlocked, the split arrester 1 is substantially equal in thickness and width to the engaged coupling element rows.

The male member 10 of the illustrated embodiment has a locking tongue portion 12 projecting from the attachment base portion 11 toward the female member 20, and a protuberance 12*a* formed at the distal end of the locking tongue portion 12 and bulging in the direction of thickness of the fastener tape T (upwardly and downwardly) to provide a neck 12*b*. The shape of the protuberance 12*a* is a substantially equilateral triangle in cross section so that the male member 10 can engage the female member 20 with ease. The female member 20 has a box-like locking hollow portion 22 for receiving the locking tongue portion 12 extending from the attachment base portion 11. In the locking hollow portion 22, there is a catch portion 22*a* which is resiliently deformable and engageable with the neck 12*b* in the direction of thickness of the fastener tape T when the protuberance 12*a* is forced into the locking hollow portion 22. The catch portion 22*a* is in the form of a pair of resilient bars spaced a distance substantially the same as the thickness of the locking tongue portion and extending between front and rear inside wall surfaces of the locking hollow portion 22 longitudinally of the fastener tape T for sandwiching the neck 12*b* of the protuberance 12*a* on opposite sides from the direction of thickness of the fastener tape T. During the interlocking, since the distance of the substantially parallel resilient bars is smaller than the thickness of the protuberance 12*a* of the locking tongue portion 12, once the protuberance 12*a* is caught by the catch portion 22*a*, the protuberance 12*a* is prevented from being removed from the catch portion 22*a*.

Figure 3:
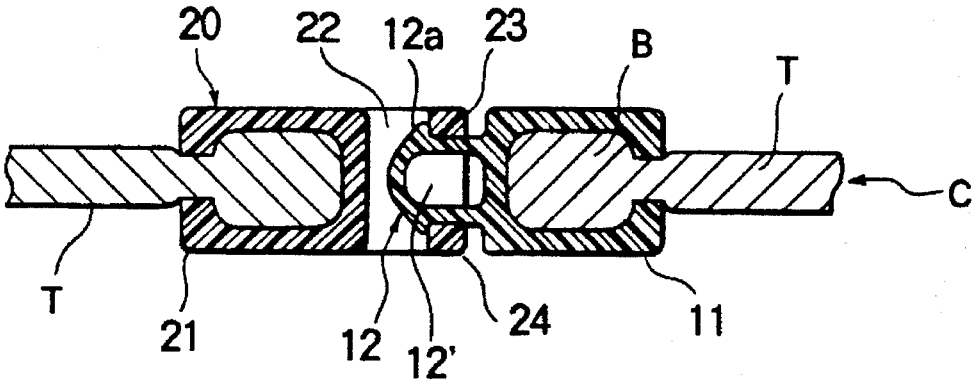
FIG. 3 is a cross-sectional view showing a modification of the first embodiment.

FIG. 3 shows a modification of the first embodiment. In the first embodiment, the resilient bars 22*a* are resiliently deformed to become wide when the protuberance 12*a* of the locking tongue portion 12 is inserted between the resilient bars 22*a*, and they restore their parallel posture to catch the protuberance 12*a* after the protuberance 12*a* is inserted. Whereas in the modified form of FIG. 3, the locking tongue portion 12 of the male member 10 has at its distal end a protuberance 12*a* bulging in the direction of thickness of the fastener tape T and has a hollow 12', extending through the locking tongue portion 12 along the entire longitudinal length thereof. Because of the hollow 12', the locking tongue portion 12 is resiliently deformable through the entire length in the direction of thickness of the fastener tape T. Therefore, the catch portion of the female member 20 is not necessarily resilient and is simply composed of first and second catch portions 23, 24 which have a predetermined degree of rigidness and extend from upper and lower portion of the inside walls on the open side of the locking hollow portion 22 of a generally C-shape cross section to engage with the protuberance 12*a*. The distance between the first and second catch portions 23, 24 is set to be smaller than the thickness of the maximum thickness of the locking tongue portion 12 in free form. With this modified arrangement, it is possible to reduce the thickness of the split arrester 1 compared to the first embodiment and to achieve adequate stability of shape after the male and female members are interlocked, thus securing a strong resistance against possible thrusting forces in the direction of thickness of the fastener tape T and possible forces in the direction of removal of the locking tongue portion 12.

Figure 4:
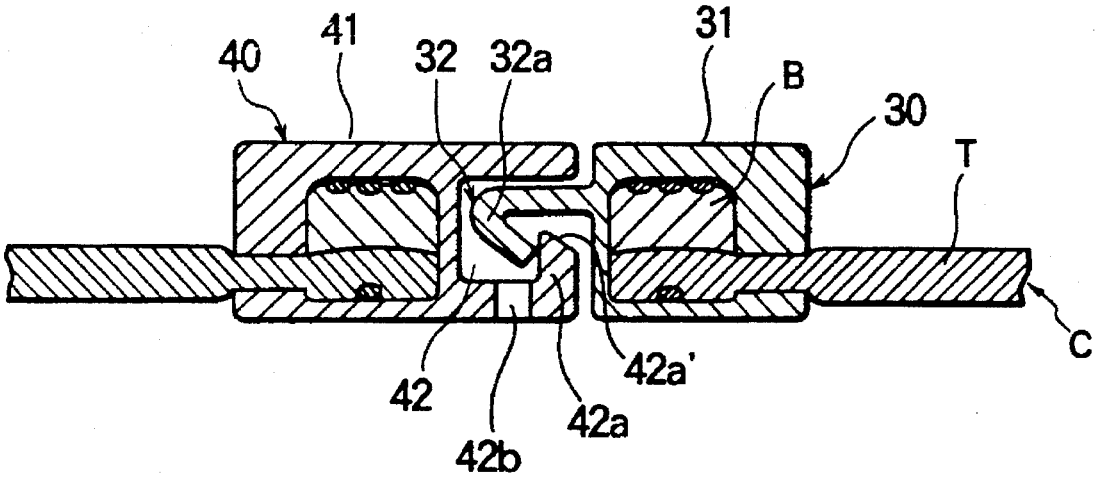
FIG. 4 is a cross-sectional view showing a split arrester of a slide fastener according to a second embodiment of the invention.

FIG. 4 shows a split arrester according to a second typical embodiment of this invention. The split arrester of the second embodiment is different from the foregoing embodiment in that a locking tongue portion 32 projecting from an attachment base portion 31 of the male member 30 has a resilient hook-shape end 32*a* instead of the protuberance 12*a*, and that a box-like locking hollow portion 42 formed in an attachment base portion 41 of the female member 40 has a catch portion 42*a*. In the illustrated example, the resilient hook-shape end 32*a* is bent downwardly by an acute angle, and the catch portion 42*a* engageable with the resilient hook-shape end 32*a* extends upwardly from the lower end (FIG. 4) of the opening of the locking hollow portion 42. The upper edge of the catch portion 42*a* has a slant surface 42*a'* so as to narrow the opening of the locking hollow portion 42 gradually toward its inside. The lower wall of the locking hollow portion 42 has an escape through hole 42*b* at a position opposite to the resilient hook-shape end 32*a* so that the locking tongue portion 31 can be removed from the locking hollow portion 42 as the resilient hook-shape end 32*a* is resiliently deformed when pressed from outside.

Figure 5:
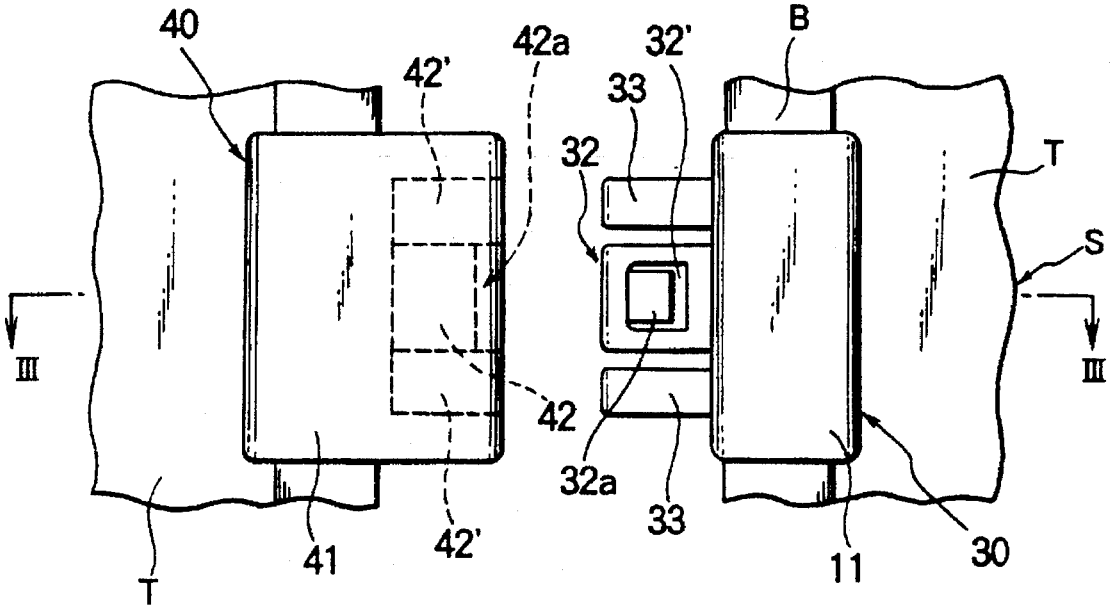
FIG. 5 is a fragmentary plan view showing a first modification of the second embodiment.
Figure 6:
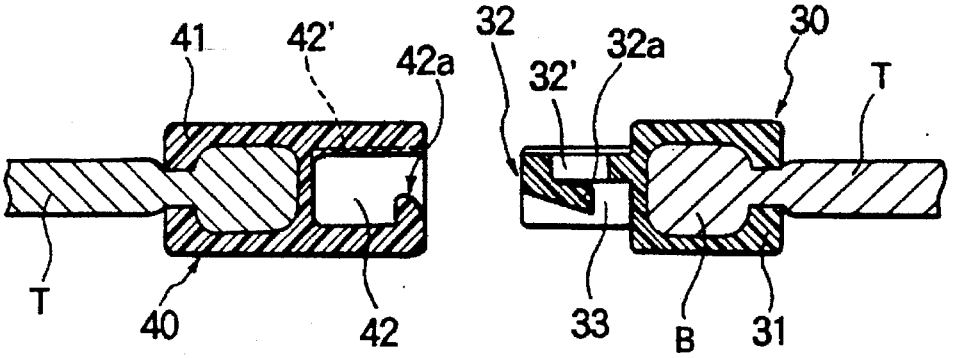
FIG. 6 is a cross-sections view taken along line III—III of FIG. 5.

FIG. 5 shows a modification of the split arrester 1 of FIG. 4. FIG. 6 is a cross-sectional view taken along line III—III of FIG. 5. The locking tongue portion 32 of the male member 30 has an aperture 32', and the resilient hook-shape end 32*a* is folded so as to face the aperture 32'. In addition, the male member 30 has a pair of insertion column portions 33 spaced a predetermined distance from each other longitudinally of the fastener tape T and situated one on each of front and rear sides of the locking tongue portion 32 in the same plane as the locking tongue portion 32. 0n the other hand, the locking hollow portion 42 of the female member 40 has a box-like hollow for receiving the resilient hook-shape end 32*a* and the insertion column portions 33, and at the insertion opening of the locking hollow portion 42, the catch portion 42*a* extending from the lower wall surface of the hollow for engagement with the resilient hook-shape end 32*a*. On each side of the catch portion 42*a*, there is a blind hole 42' for receiving the respective insertion column portion 33. No escape through hole 42*b* exists in this example; however it may be formed in the lower wall of the locking hollow portion 42. Since the resilient hook-shape end 32*a* is folded so as to face the aperture 32', it is possible to reduce the thickness of the locking tongue portion 32 and the resilient hook-shape end 32*a* and hence the thickness of the entire split arrester 1 compared to the embodiment of FIG. 4 is reduced. Further, the insertion column portions 33 and the blind holes 42' jointly serve to secure the shape stability of the split arrester 1 after the male and female members 30, 40 are interlocked and also to guarantee the stability of engaging strength of the resilient hook-shape end 32*a* and the catch portion 42*a*.

Figure 7:
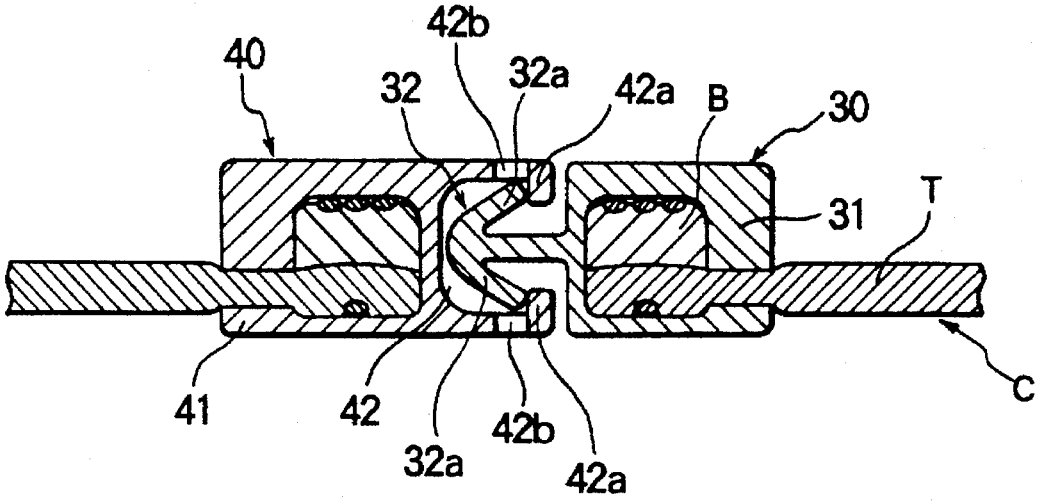
FIG. 7 is a cross sectional view showing a second modification of the second embodiment.
Figure 8:
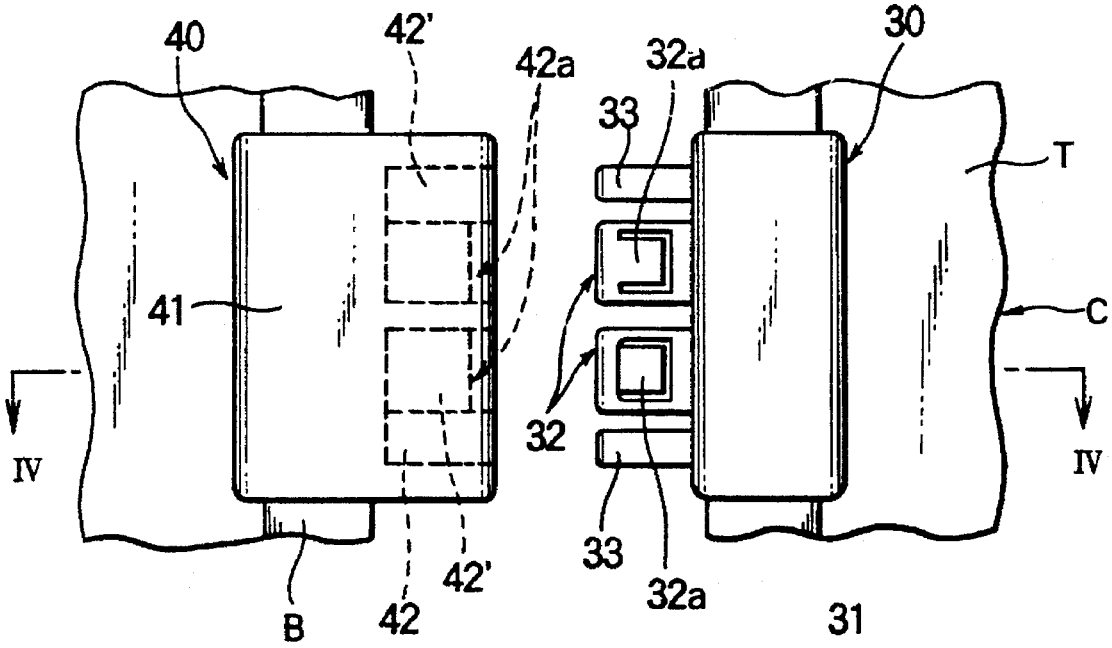
FIG. 8 is a plan view showing a third modification of the second embodiment.
Figure 9:
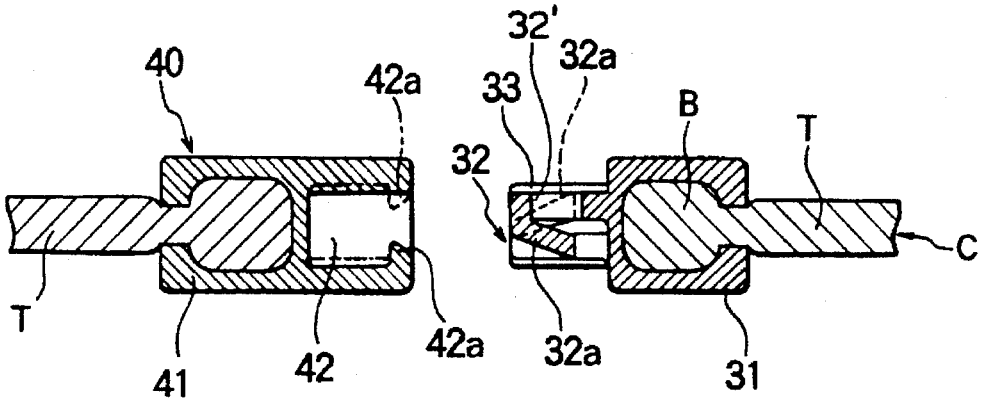
FIG. 9 is a cross-sectional view taken along line IV—IV of FIG. 8.

FIG. 7 shows another modification of the embodiment of FIG. 4. In the embodiment of FIG, 4, one resilient hook-shape end 32*a* and one coacting catch portion 42*a* are provided. Whereas in the modification of FIG. 7, there is a pair of resilient hook-shape ends 32*a* projecting from the locking tongue portion 32 upwardly and downwardly in the direction of thickness of the fastener tape T. And the female member 40 has a pair of catch portions 42*a* extending from the upper and lower wall surfaces of the insertion opening of the locking hollow portion 42 toward each other for engagement with the respective resilient hook-shape ends 32*a*. FIG. 8 shows a modification of the split arrester 1 of FIG. 5. FIG. 9 is a cross-sectional view taken along line IV—IV of FIG. 8. In the modification of FIGS. 8 and 9, a pair of resilient hook-shape ends 32*a* extend from a pair of locking tongue portions 32 respectively and are arranged longitudinally of the fastener tape T, being directed oppositely in the direction of thickness of the fastener tape T. With this modified arrangement, it is possible not only to prevent the male member 30 perfectly from being removed from the female member 40 due to possible thrusting forces acting on the split arrester 1 particularly in the direction of thickness of the fastener tape T, but also to secure adequate shape stability of the split arrester 1 at the time of interlocking and adequate stability of engaging strength of the resilient hook-shape ends 32*a* and the catch portions 42*a*. Throughout the foregoing views, like reference numerals designate similar parts or elements.

Figure 10:
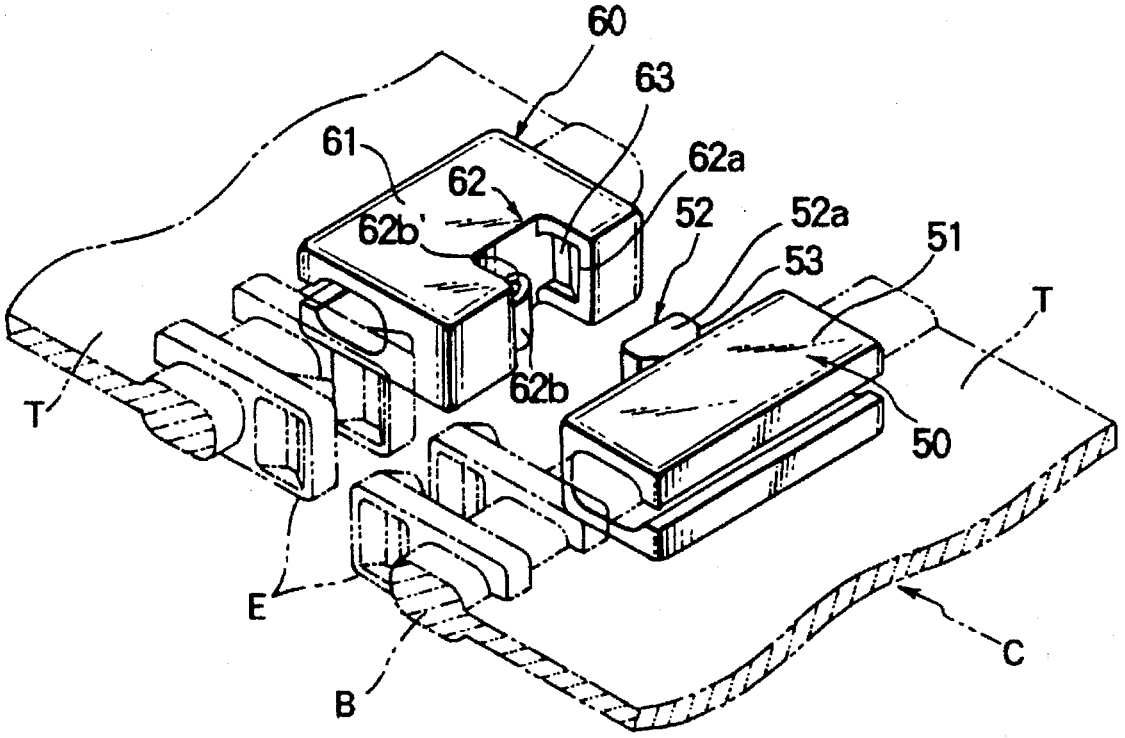
FIG. 10 is a fragmentary perspective view showing a split arrester of a slide fastener according to a third embodiment of the invention.
Figure 11:
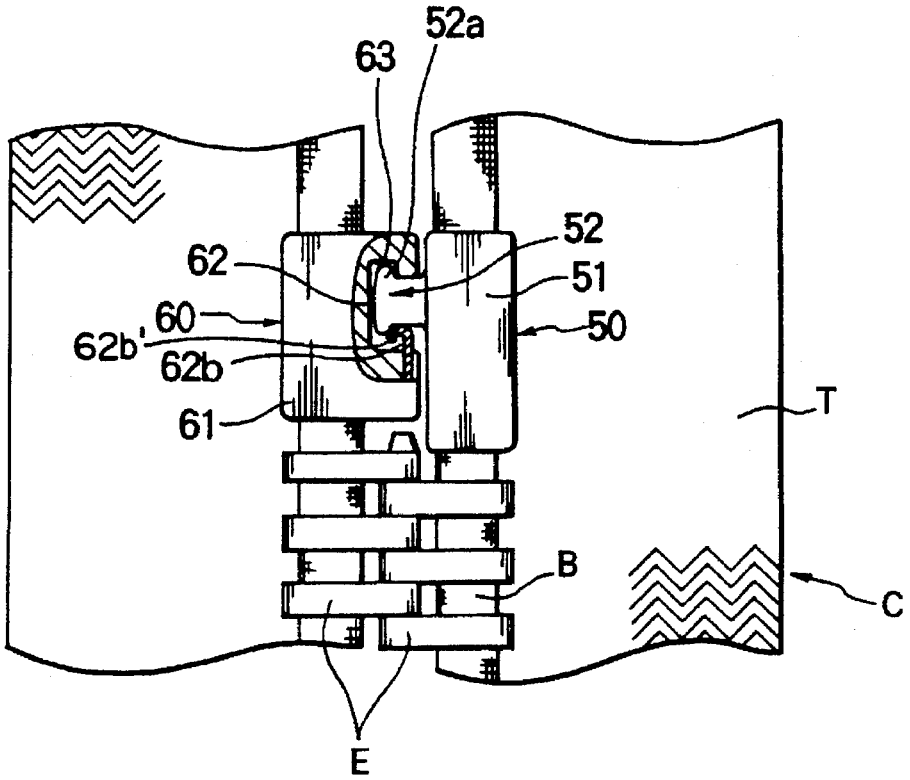
FIG. 11 is a plan view, with parts broken away, of the split arrester of the third embodiment.

FIGS. 10 and 11 show a third embodiment of this invention. FIG. 10 is a fragmentary perspective view mainly showing a split arrester 1 applied to a slide fastener, and FIG. 11 is a plan view, on a reduced scale, of FIG. 10. In the illustrated embodiment, the split arrester 1 is composed of interlocking male and female members 50, 60 mounted on the slide fastener contiguously to the respective terminal portions of opposed coupling element rows of the fastener chain C, each of the male and female members 50, 60 being substantially equal in thickness and width to the coupling elements E. The male and female members 50, 60 jointly prevent the interengaged coupling element rows from splitting when a non-illustrated slider is removed from the fastener chain C.

The male member 50 of the split arrester 1 has a generally T-shape locking tongue portion 52 projecting from an attachment base portion 51 toward tile male member 60 and having at its distal end a protuberance 52*a* bulging in opposite directions longitudinally of the fastener tape T. On the other hand, the female member 60 has a generally C-shape locking portion 62 for receiving the locking tongue portion 52 and supporting the same at its front and rear surfaces, and first and second catch projections 62*a*, 62*b* extending from the front and rear inside wall surfaces of the locking portion 62 at the open side toward each other. At least one of the first and second catch projections 62*a*, 62*b* is in the form of a resilient strip for resiliently pressing the front or rear side surface of a neck 53 of the protuberance 52*a*. According to the arrangement of FIGS. 10 and 11, the second catch projection 62*b* is a metallic leaf spring, the base of which is embedded in the rear inside wall surface of the locking tongue portion 62, and a projected free end portion 62*b'* is curved arcuately inwardly of the locking portion 62.

Figure 12:
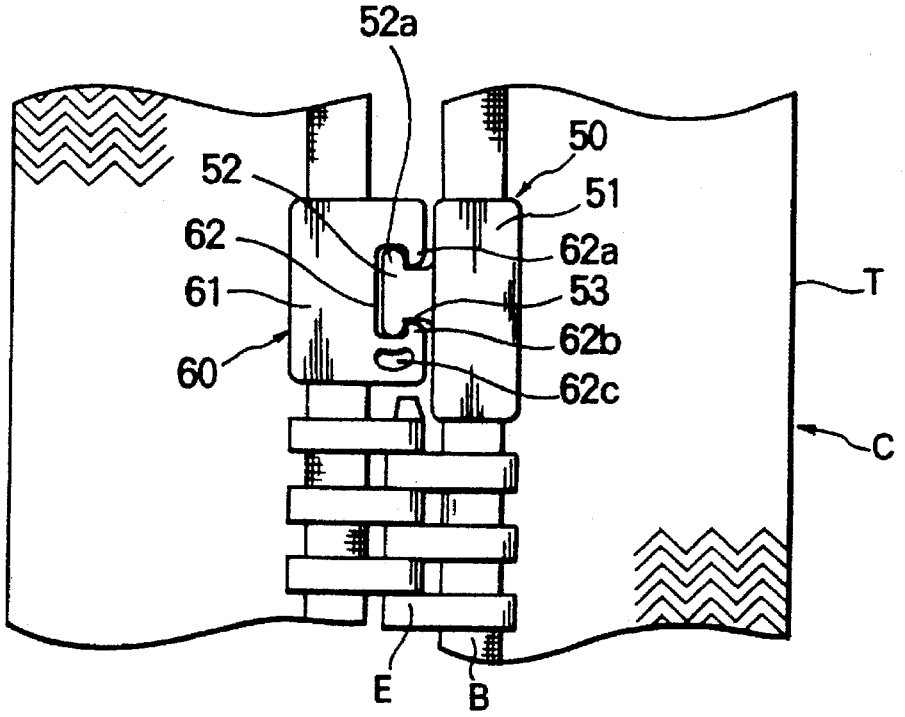
FIG. 12 is a plan view showing a modification of the third embodiment.

When the locking tongue portion 52 of the male member 50 is inserted into the locking portion 62 of the female member 60, the metallic leaf spring 62*b* mounted at the open end of the locking portion 62 resiliently deforms to allow the protuberance 52*a* to pass and then restores its original shape in such a manner that the projected free end portion 62*b* resiliently presses the neck 53 of the protuberance 52*a* against the first catch projection 62*a*, thus holding the neck 53 between the leaf spring 62*b* and the first catch projection 62*a* firmly from front and rear sides in the longitudinal direction of the fastener tape T. At that time, since the free end portion 62*b'* of the metallic leaf spring 62*b* is curved arcuately inwardly of the locking portion 62, the pressure of the metallic leaf spring 62*b* against the neck 53 increases so that the interlocking force between the male and female members 50, 60 is increased to reliably prevent the protuberance 52*a* from accidental removal. Further, in this embodiment, since the inside wall surface from which the first catch projection 62*a* of the locking portion 62 extends has a recess 63 having a bottom surface becoming progressively deeper toward the attachment base portion 61, it is possible to perfectly prevent the male member 50 from being removed from the female member 60 due to the thrusting forces acting on the split arrester 1 in the direction of thickness of the fastener tape T. FIG. 12 shows a modification of the third embodiment. According to this modification, the entire female member 60 is made of synthetic resin material and the locking portion 62 has a vertical through hole 62*c* at a position toward the second catch projection 62*b*. Therefore the through-hole-side part of the locking portion 62 is resiliently deformable entirely so that the male member 50 can be inserted into the female member 60 without difficulty. Assuming that the lateral pulling forces act on the locking tongue portion 52, the resilient pressure acting on the neck 53 of the protuberance 52*a* due to the second catch projection 62*b* increases so that the engaging strength between the protuberance 52*a* and the first and second catch projections 62*a*, 62*b* is increased.

Figure 13:
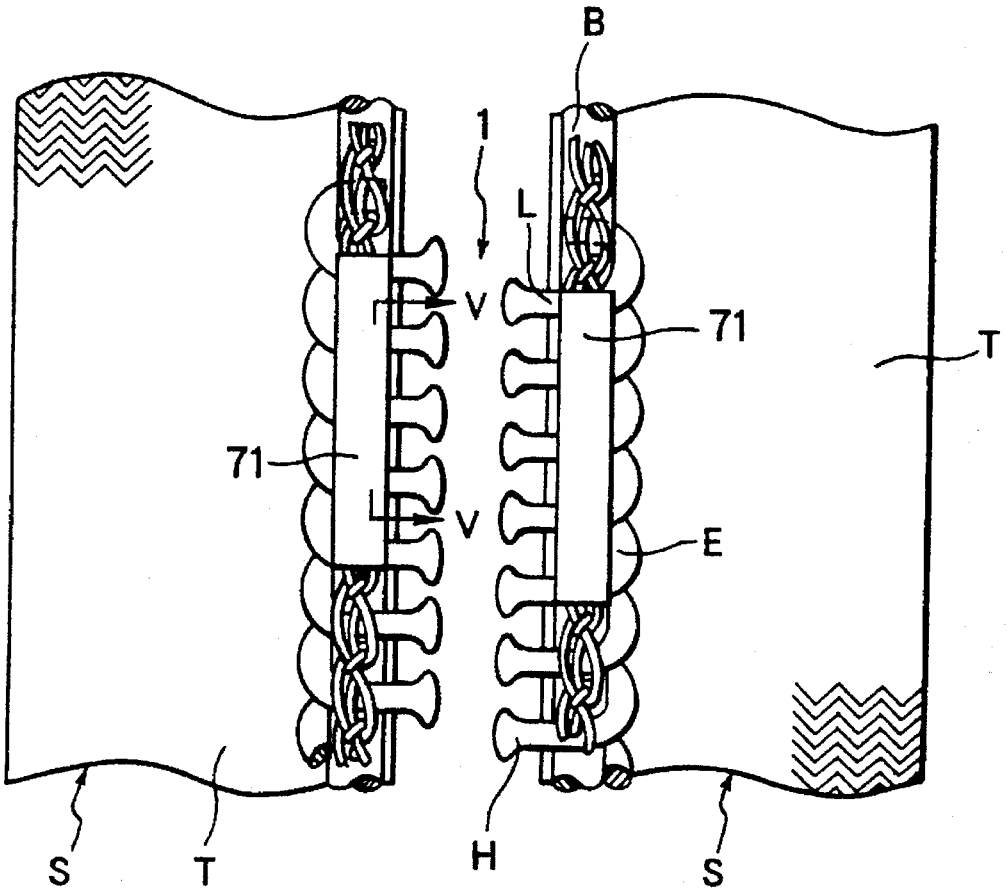
FIG. 13 a fragmentary plan view showing a split arrester of a slide fastener according to a fourth embodiment of the invention.
Figure 14:
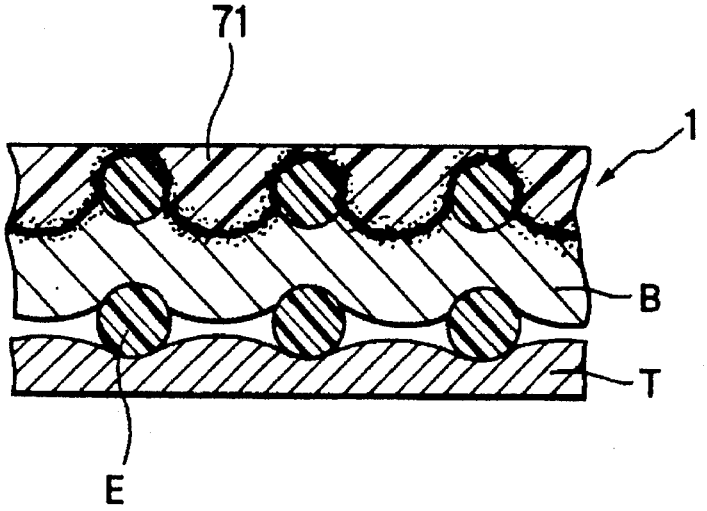
FIG. 14 is an enlarged cross-sectional view taken along line V—V FIG. 13.

FIG. 13 shows a split arrester 1 according to a fourth embodiment of this invention. In this embodiment, the split arrester 1 utilizes coupling elements of the fastener chain C. Specifically, a number of coupling elements E of a terminal portion of each of opposed coiled coupling element rows of a pair of fastener stringers S are connected together into a unitary form by welding the leg portions with a synthetic resin strip 71. The coupling elements E should by no means be limited to the coiled continuous type and may be of the discrete type. FIG. 14 is a cross-sectional view taken along line V—V of FIG. 13, showing the manner in which the leg portion of the coupling elements E and the synthetic resin strip 71 are welded. As shown in FIG. 14, the synthetic resin strip 71 set over the leg portions L of the several coupling elements E in the terminal part of the fastener stringer S is molten by, for example, ultrasound to penetrate molten resin into the surfaces of the coupling elements E and the core thread B, thus joining these members together in an integral form. With this integral form, since the leg portions L of the coupling elements E connected together by the synthetic resin strip 71 is free from any resilient deformation except that only coupling head portions H can resiliently deform slightly, the distance between the adjacent coupling elements E does not become wide so that the head portions H of one coupling element row of the closed slide fastener will hardly be accidentally disengaged from those of the other coupling element row. Preferably, the synthetic resin strip 71 and the coupling elements E are made of the same material so that they can be welded together easily. The thickness and width of the synthetic resin strip maybe selected as desired in connection with the coupling elements E.

Figure 15:
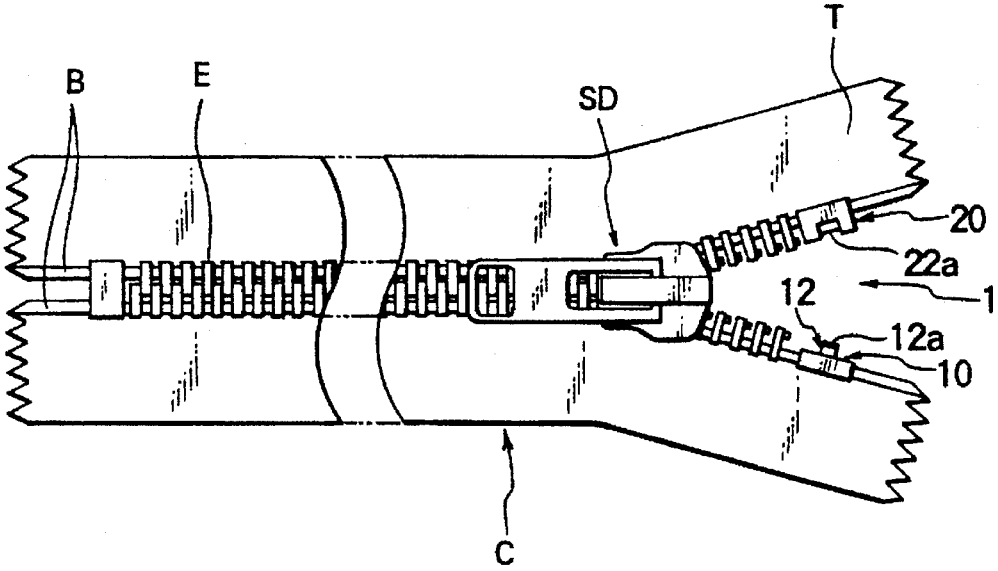
FIG. 15 is a plan view showing the slide fastener of the invention as partly closed.
Figure 16:
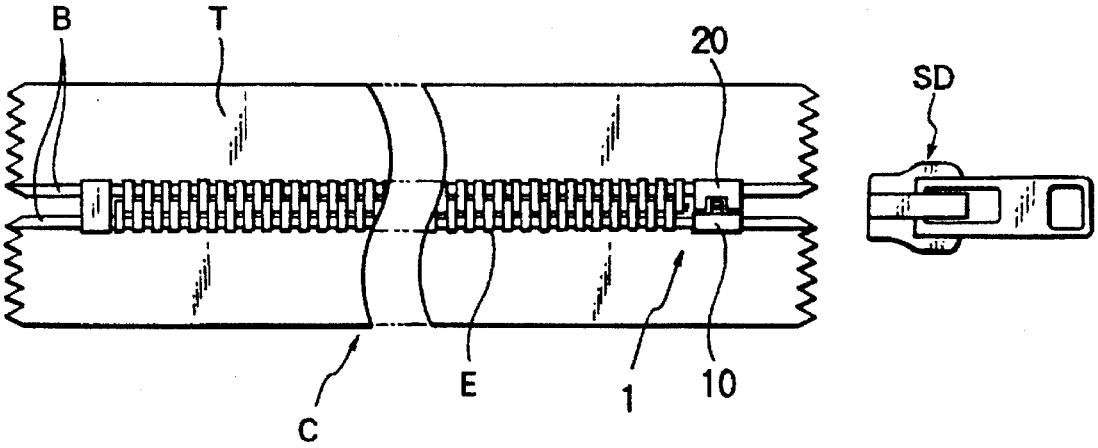
FIG. 16 is a plan view showing the slide fastener of the invention as completely closed.

FIGS. 15 and 16 show the manner in which a slide fastener F utilizing the first embodiment of FIG. 1 is used. The slide fastener F is closed by operating a slider SD as usual, and then the slider SD is removed from the fastener chain C. As the the slider SD is removed, the locking tongue portion 12 of the male member 10 comes into engagement with the catch portion 22*a* of the female member 20. After the slider SD is removed, the male and female members 10, 20 will not be accidentally disengaged from each other even if lateral pulling forces act on the fastener tape T or thrusting forces act on the coupling element rows in the direction of thickness of the fastener tape T.

Various other modifications may be suggested, and such modified products may be manufactured by injecting molding, for example.

As is understood from the foregoing description, according to the slide fastener of this invention, more particularly in the first and second embodiments, since the male member 10, 30 is engaged and supported by the female member 20, 40 in the direction of thickness of the fastener tape T, it is possible to secure adequate interlocking strength of the male and female members against the lateral pulling forces acting on the fastener chain C as well as against the thrusting forces acting on the split arrester 1 in the direction of thickness of the fastener chain C. In the second embodiment, particularly in the example in which the female member 40 has the escape through hole 42*b*, the male and female members 30, 40 as interlocked can be separated by inserting a dedicated jig into the escape through hole 42*b* to push the locking hook-shape end 32*a* from outside for resilient deformation. In this case, it is possible to separate interconnected carpets apart for washing or other purposes. In the case of a seat cover, it can be exchanged with another.

In the third embodiment of this invention, since the locking tongue portion 52 of the male member 50 is engaged and supported by the resilient catch projection 62*b* and the recess 63 of the female member 60 in the direction of thickness of the fastener tape T and longitudinally of the fastener tape T, it is possible to secure adequate interlocking strength against forces acting in the direction of thickness and width of the fastener chain C. Further, in the fourth embodiment of this invention, the split arrester 1 effectively utilizes the coupling elements E of terminal part of the coupling element row, and it is not necessary to provide a split arrester composed of male and female members on the fastener chain C. With the simple structure including a plurality of coupling elements E which are connected by welding with a strip 71 of the same material, it suppresses the coupling elements E from resilient deformation, so that the coupling elements E can be prevented from accidental splitting.

With the foregoing arrangements of this invention, it is not necessary to have an end of the fastener chain projecting from the interconnected sheets, and the step of cutting the fastener tapes in chevron is not required. Further, the male and female members can be interlocked with adequate firmness against the lateral pulling forces and thrusting forces acting on the slide fastener. It is also possible to improve the rate of production and to reduce the cost of production.

What is claimed is:

1. A slide fastener comprising:

(a) a pair of fastener stringers each having a fastener tape and a row of coupling elements mounted on and along an inner edge of said fastener tape for being coupled with the coupling element row of a companion fastener tape;

(b) a slider removably threaded on said pair of fastener stringers;

(c) a split arrester composed of male and female members to be interlocked when said slider is removed from said fastener stringers, said male and female members being mounted on the respective inner edges of the opposed fastener tapes at positions contiguous to top ends of said coupling element rows, each of said male and female members being substantially equal in thickness and width to said coupling elements;

(d) said male member of said split arrester having an attachment base portion attached to one of the opposed fastener tapes and a locking tongue portion projecting from said attachment base portion toward said female member; and (e) said female member of said split arrester having an attachment base portion attached to the other fastener tape with a locking hollow portion formed therein for receiving said locking tongue portion and a catch portion engageable with said locking tongue portion in said locking hollow portion in a direction of thickness of said slide fastener.

2. A slide fastener according to claim 1, wherein said female member has an escape through hole communicating with said locking hollow portion.

3. A slide fastener according to claim 1, wherein said locking tongue portion has on its distal end a protuberance to define a neck, and wherein said catch portion is in the form of a pair of resilient bars extending longitudinally of the fastener tape between front and rear inside wall surfaces of said locking hollow portion and being parallel spaced a predetermined distance from each other in the direction of thickness of said fastener tape for pinching said neck from opposite sides in the direction of thickness of said fastener tape.

4. A slide fastener according to claim 1, wherein said locking tongue portion of said male member has a generally T-shape cross section and has on its distal end a protuberance bulging in the direction of thickness of said fastener tape, wherein said locking hollow portion of said female member having a generally C-shape cross section in which said locking tongue portion is received and held, wherein said catch portions extending from upper and lower inside wall surfaces of said locking hollow portion in parallel for engaging said protuberance of said locking tongue portion in the direction of thickness of said fastener tape are provided at an open end of said locking hollow portion, and wherein said locking tongue portion is resiliently deformable through its entire length between said catch portions.

5. A slide fastener according to claim 1, wherein said locking tongue portion has at its distal end a resilient hook-shape end extending in the direction of thickness of said fastener tape, and wherein said catch portion projects in said locking hollow portion in the direction of thickness of said fastener tape for engaging said resilient hook-shape end.

6. A slide fastener according to claim 5, wherein said locking tongue portion of said male member has an aperture to which the resilient hook-shape end faces as being folded.

7. A slide fastener according to claim 5, wherein said resilient hook-shape end of said locking tongue portion is a single-hook structure.

8. A slide fastener according to claim 5, wherein said resilient hook-shape end and said catch portion extend toward each other in the direction of thickness of said fastener tape.

9. A slide fastener according to claim 5, wherein a plurality of said resilient hook-shape end of said locking tongue portion are arranged longitudinally of said fastener tape, said resilient hook-shape ends projecting alternately upwardly and downwardly in a direction of thickness of said fastener tape, wherein said locking hollow portion is a multiple-hollow structure composed of a plurality of hollow portions for receiving said resilient hook-shape ends individually, and wherein a plurality of said catch portion extend in the respective locking hollow portions to engage the respective resilient hook-shape ends in the direction of thickness of said fastener tape.

10. A slide fastener according to claim 5, wherein said locking hollow portion has an escape through hole in its wall at a position confronting said resilient hook-shape end.

11. A slide fastener comprising:

(a) a pair of fastener stringers each having a fastener tape and a row of coupling elements mounted on and along an inner edge of said fastener tape for being coupled with the coupling element row of a companion fastener tape;

(b) a slider removably threaded on said pair of fastener stringers;

(c) a split arrester composed of male and female members to be interlocked when said slider is removed from said fastener stringers, said male and female members being mounted on the respective inner edges of the opposed fastener tapes at positions contiguous to top ends of said coupling element rows, each of said male and female members being substantially equal in thickness and width to said coupling elements;

(d) said male member of said split arrester having an attachment base portion attached to one of the opposed fastener tape and a generally T-shape locking tongue portion projecting from said attachment base portion toward said female member, said T-shape locking tongue portion having at its distal end a protuberance bulging in opposite directions longitudinally of said fastener tape to define a neck; and (e) said female member of said split arrester having an attachment base portion attached to the other fastener tape with a generally C-shape locking portion formed therein in which said locking tongue portion is received and held at front and rear sides of said neck thereof, with first and second catch projections provided on opposed inside wall surfaces of said locking portion toward each other for engaging said protuberance of said locking tongue portion being provided at an open end of said locking portion, at least one of said first and second catch projections being a separate metallic spring for pressing the front or rear side of the neck resiliently;

wherein said locking portion has a recess on an inside wall surface thereof for receiving said protuberance of said locking tongue portion.

12. A slide fastener comprising:

(a) a pair of fastener stringers each having a fastener tape and row of coupling elements mounted on and along an inner edge of said fastener tape for being coupled with the coupling element row of a companion fastener tape;

(b) a slider removably threaded on said pair of fastener stringers;

(c) a split arrester composed of male and female members to be interlocked when said slider is removed from said fastener stringers, said male and female members being mounted on the respective inner edges of the opposed fastener tapes at positions contiguous to top ends of said coupling element rows, each of said male and female members being substantially equal in thickness and width to said coupling elements;

(d) said male member of said split arrester having an attachment base portion attached to one of the opposed fastener tapes and a generally T-shape locking tongue portion projecting from said attachment base portion toward said female member, said T-shape locking tongue portion having at its distal end a protuberance bulging in opposite directions longitudinally of said fastener tape to define a neck; and (e) said female member of said split arrester having an attachment base portion attached to the other fastener tape with a generally C-shape locking portion formed therein in which said locking tongue portion is received and held at front and rear sides of said neck thereof, with first and second catch projections provided on opposed inside wall surfaces of said locking portion toward each other for engaging said protuberance of said locking tongue portion being provided at an open end of said locking portion, at least one of said first and second catch projections being composed of resilient material for pressing the front or rear side of the neck resiliently;

wherein said female member is made of synthetic resin material and said locking portion has a vertical through hole at a position toward said second catch projection so that a through hole-side part of said locking portion is resiliently deformable entirely.

13. A slide fastener comprising:

(a) a pair of fastener stringers each having a fastener tape and a row of coupling elements mounted on and along an inner edge of said fastener tape for being coupled with the coupling element row of a companion fastener tape;

(b) a slider removably threaded on said pair of fastener stringers; and (c) a split arrester composed of male and female members to be interlocked when said slider is removed from said fastener stringers, said male and female members being mounted on the respective inner edges of the opposed fastener tapes at positions contiguous to top ends of said coupling element rows, each of said male and female members being substantially equal in thickness and width to said coupling elements;

(d) each of said male and female members of said split arrester including a plurality of coupling elements of the respective fastener stringer, said coupling elements of said male member being arranged in a staggered manner with respect to those of said female member, said coupling elements of each of said male and female members being welded together in a direction along said inner edge of said fastener tapes using a synthetic resin material, said coupling elements of said male and female members being more rigidly connected by said welding than adjoining nonwelded coupling elements of said fastener tapes.

14. A slide fastener according to claim 13, wherein said coupling elements are coiled elements, said synthetic resin material being in the form of a strip extending over a number of coupling elements.

* * * * *